US006413114B2

(12) United States Patent
Fukamachi

(10) Patent No.: US 6,413,114 B2
(45) Date of Patent: Jul. 2, 2002

(54) CONNECTOR

(75) Inventor: Makoto Fukamachi, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/754,402

(22) Filed: Jan. 5, 2001

(30) Foreign Application Priority Data

Feb. 3, 2000 (JP) ..... 2000-026138

(51) Int. Cl.[7] ..... H01R 13/64
(52) U.S. Cl. ..... 439/374; 439/680
(58) Field of Search ..... 439/374, 680, 439/924.1, 79, 934, 181, 186

(56) References Cited

U.S. PATENT DOCUMENTS 3,008,116 A * 11/1961 Blanchenot ..... 439/317
4,229,064 A * 10/1980 Vetter et al. ..... 439/317
5,238,413 A * 8/1993 McCaffrey et al. ..... 439/79
5,263,872 A 11/1993 Marpoe, Jr. et al. ..... 439/188
5,613,871 A * 3/1997 Akeda ..... 439/374

* cited by examiner

*Primary Examiner*—Gary Paumen
*Assistant Examiner*—Ann McCamey
(74) *Attorney, Agent, or Firm*—Banner & Witcoff, Ltd.

(57) ABSTRACT

The present invention prevents a female connector that has been inserted in an inclined manner from interfering with male terminal fittings within a connector having long male terminal fittings provided in a central location within a hood. A cylindrical member 13 surrounding long male terminal fittings 12L protrudes from an inner side face 11 of the hood 10. Interferences between the long male terminal fittings 12L, and a comer Fb of a female connector F is prevented by appropriately determining the length to which the cylindrical member 13 will protrude. Interference between the female connector F and the long male terminal fittings 12 does not need to be taken into consideration in determining the protruding length of the hood 10. Consequently, the protruding length of the hood 10 can be relatively short.

6 Claims, 5 Drawing Sheets

CONNECTOR

TECHNICAL FIELD

The present invention relates to an electrical connector.

BACKGROUND TO THE INVENTION

An example of a conventional connector is shown in FIGS. 4 and 5 of this specification. This is a male connector in which a plurality of male terminal fittings protrude from an inner end face of a hood formed within a housing, a female connector being fitted into this hood. Since long and wide male terminal fittings 101L and narrow and short male terminal fittings 101S are mixed within a single hood 102, this connector is termed a hybrid.

When this connector 100 is to be fitted with a female connector 105, the long male terminal fittings 101L are first engaged with female terminal fittings (not shown) then the short male terminal fittings 101S are engaged with female terminal fittings. Since two differing sets of terminal fittings are fitted together, there is a time lapse between the onset of fitting resistance of the long and short terminal fittings 101L and 101S. As a result, if the long terminal fittings 101L are provided on either a left or a right side (relative to the fitting direction of the hood 102), when fitting commences either a left or right edge (whichever edge does not receive fitting resistance) of the female connector 105 will protrude more deeply, in an inclined manner, into the interior of the hood 102, thereby impeding the fitting operation.

In order to deal with this problem, a configuration has been employed whereby the long male terminal fittings 101L are provided as a group in a central location relative to the up-down and left-right directions (relative to the fitting direction of the hood 102), and the short male terminal fittings 101S are provided around these centrally located long male terminal fittings 101L (see FIG. 4). Alternatively, the short male terminal fittings 101S are provided in the central location, and the long male terminal fittings 101L are provided therearound (not shown).

However, the female connector 105 may be inserted in an inclined manner into the hood 102, not due to fitting resistance, but because the operator inserts the female connector 105 in a misaligned manner. As a result, in order to prevent the female connector 105 and the male terminal fittings 101L and 101S from interfering with one another, it is necessary to extend the length B of the hood 102 so that an open end 102A of this hood 102 comes to be located to the anterior of tips of the male terminal fittings 101L and 101S.

In this case, as shown in FIG. 5, if the female connector 105 is fitted in an inclined manner and is in a state whereby it makes contact with the open end 102A of the hood 102 (in the most deeply inserted state), a corner 105A can be located at any position along a semicircle 104 (shown by the broken line in FIG. 5) along the open end 102A of the hood 102. That is, the deepest insertion depth of the corner 105A corresponds to the centre of the open side of the hood 102 (the central location in the up-down direction of FIG. 5).

In order to prevent interference between the female connector 105 and the male terminal fittings 101L and 101S whilst simultaneously keeping the extending length B of the hood 102 short, the short male terminal fittings 101S should be provided in the central location and the long male terminal fittings 101L should be provided therearound (in the up-down direction of FIG. 5). This configuration is not shown. By providing the two male terminal fittings 101S and 101L of differing lengths in this manner, the female connector 105 will not incline due to the existence of a time lapse between the onset of the fitting resistance of the male terminal fittings 101S and 101L.

However, in the case where there are many more long male terminal fittings 101L than short male terminals fittings 101S, or when there are few long male terminal fittings 101L but they must be provided in the central location (as shown in FIG. 4), the extending length B of the hood 102 must be made relatively long in order to prevent the long male terminal fittings 101L from interfering with the corner 105A of the female connector 105.

The present invention has taken the above problem into consideration, and aims to prevent a female connector that has been inserted in an inclined manner from interfering with male terminal fittings within a connector having long male terminal fittings provided in a central location within a hood that extends for as short a length as possible.

SUMMARY OF THE INVENTION

According to the invention there is provided an electrical connector having a body, long and short terminal fittings protruding from said body in a fitting direction, and a hood surrounding said terminal fittings, the long terminal fittings being provided centrally in a group, and the short terminal fittings substantially surrounding the long terminal fittings, characterised in that a substantially tubular member extends around and projects beyond at least some of said long terminal fittings, said tubular member projecting in the same direction as said hood, and being adapted to prevent contact between a mating connector and said long terminal fittings.

Such a tubular member protects the long terminal fittings against contact damage due to incorrect assembly. The tubular member may be circumferentially incomplete, for example it may have axial slots, whilst still providing the required degree of protection.

Preferably the tubular member is circumferentially complete, and in the preferred embodiment the tubular member surrounds all of the long terminal fittings, and only the long terminal fittings.

BRIEF DESCRIPTION OF THE DRAWINGS

Other features of the invention will be apparent from the following description of a preferred embodiment shown by way of example only in the accompanying drawings, in which.

DESCRIPTION OF PREFERRED EMBODIMENT

Figure 1:
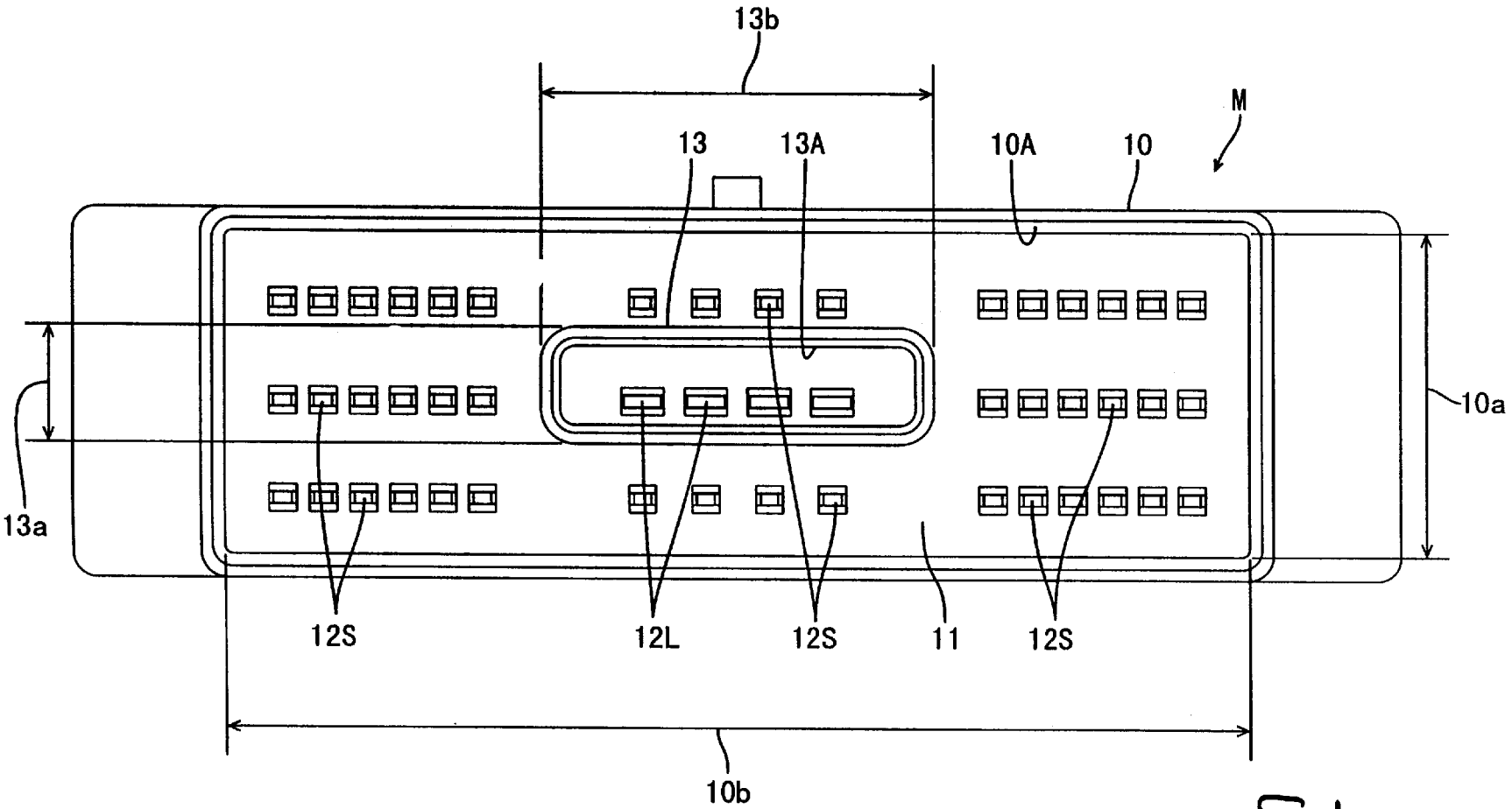
FIG. 1 is a front view of an embodiment of the invention.

An embodiment of the present invention is described below with the aid of FIGS. 1 to 3.

Figure 2:
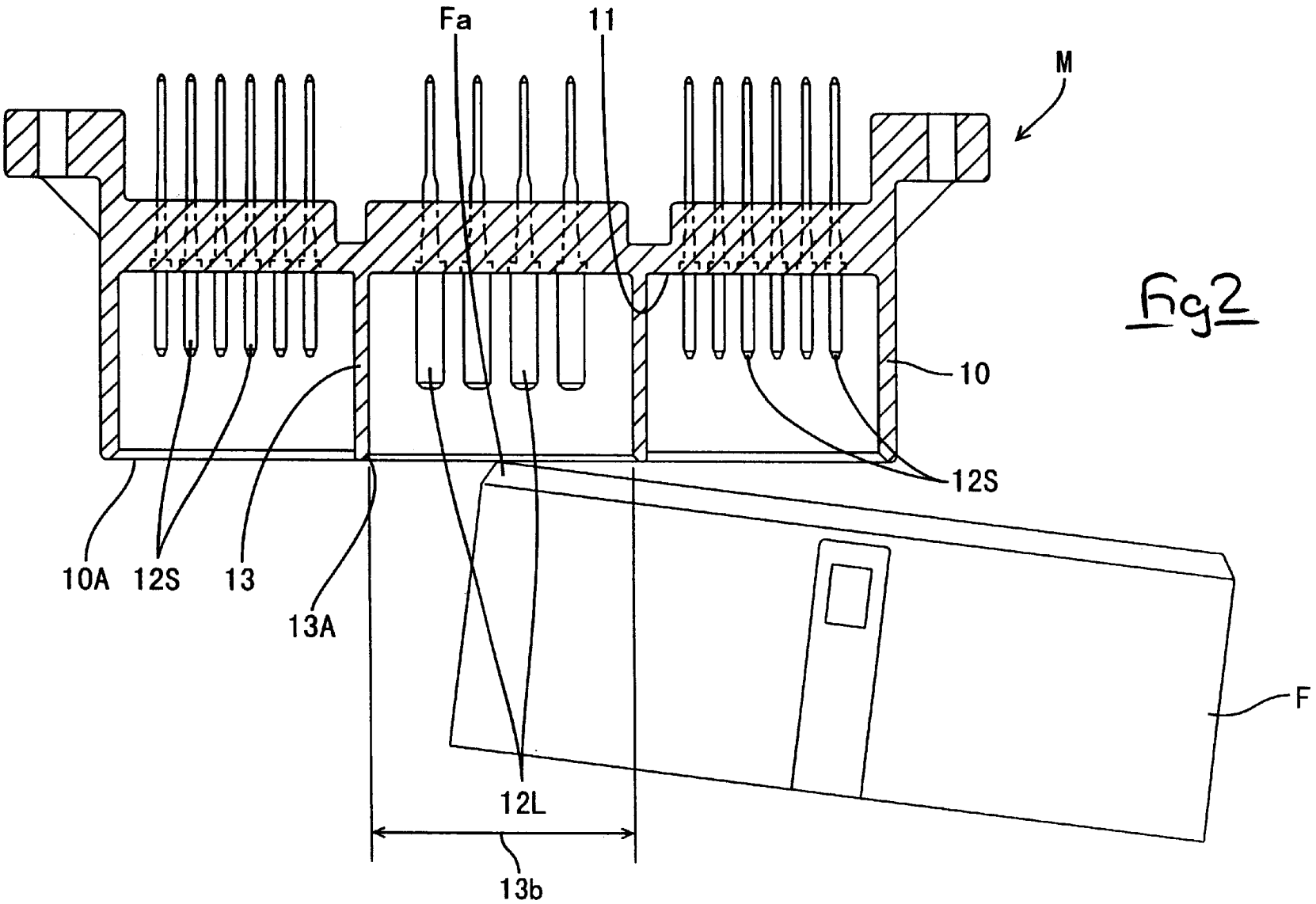
FIG. 2 is a partially cut-away plan view of the embodiment of FIG. 1 showing a female connector being inserted in an inclined state.

A connector M of the present embodiment is provided with an angular tubular hood 10 that protrudes in an anterior direction (towards the right in FIG. 2). A female connector F is inserted into this hood 10, thereby fitting the two connectors M and F together.

The hood 10 houses two types of terminal fittings, wide and long male terminal fittings 12L, and narrow and short male terminal fittings 12S. These protrude towards the anterior from an inner side face 11 of the hood 10.

Viewed from the fitting direction of the female connector F (that is, viewing the hood 10 from the anterior), the long male terminal fittings 12L, are provided as a group in a central location relative to the up-down and left-right directions of the hood 10, and the short male terminal fittings 12S are provided around these centrally-located long male terminal fittings 12L. This type of positioning is possible because there are few long male terminal fittings 12L (there are four in the present embodiment), whereas the short male terminal fittings 12S are much more numerous (there are forty-four in the present embodiment.

A cylindrical member 13 protrudes towards the anterior from the inner side face 11 of the hood 10 (in the same direction as the direction of protrusion of the hood 10). Like the hood 10, this cylindrical member 13 has an angular tubular shape. Upper, lower, left, and right side walls thereof are parallel to upper, lower, left, and right side walls of the hood 10. Viewed from the fitting direction of the female connector F, the long male terminal fittings 12L alone are enclosed by the cylindrical member 13. The short male terminal fittings 12S are present in the space between the upper, lower, left and right side walls of the cylindrical member 13 and the upper, lower, left and right side walls of the hood 10. A protruding end of the cylindrical member 13 is situated at the same location as an open end 10A (a protruding end) of the hood 10, this open end 10A being open in the fitting direction of the female connector F.

The opening size and protruding size of the cylindrical member 13 are as follows: the opening size 13*a* of the cylindrical member 13 in the up-down direction is smaller than the left-right opening size 13*b* thereof. Furthermore, the distance S between a protruding end 13A of the cylindrical member 13 (this protruding in the fitting direction of the female connector F) and protruding ends of the long male terminal fittings 12L is greater than half of the opening size 13*a* (the opening size of the cylindrical member 13 in the up-down direction, this being smaller than the left-right opening size 13*b*).

The female connector F has a groove (not shown) for preventing interference with the cylindrical member 13.

When the female connector F is in an inclined state relative to the connector M of the present embodiment (but parallel to the plane of the page that has FIG. 2), a left anterior corner Fa thereof approaches the long male terminal fittings 12L (see FIG. 2).

Since the up-down opening size 13*a* of the cylindrical member 13 is less than an up-down opening size 10*a* of the hood 10 (corresponding to the thickness of the female connector F), the left anterior corner Fa makes contact with upper or lower edges of the protruding end 13A of the cylindrical member 13 and, consequently, the corner Fa cannot enter the cylindrical member 13. As a result, the female connector F does not interfere with the long male terminal fittings 12L.

When the female connector F is in a state whereby it is inclined in an up-down direction relative to the connector M, either the upper or lower corner thereof approaches the long male terminal fittings 12L. Since the left-right opening size 13*b* of the cylindrical member 13 is less than a left-right opening size 10*b* of the hood 10 (corresponding to the left-right width of the female connector F), as in the case above, its corner makes contact with left and right edges of the protruding end 13A of the cylindrical member 13 and, consequently, the corner cannot enter the cylindrical member 13. As a result, in this case also, the female connector F does not interfere with the long male terminal fittings 12L.

Figure 3:
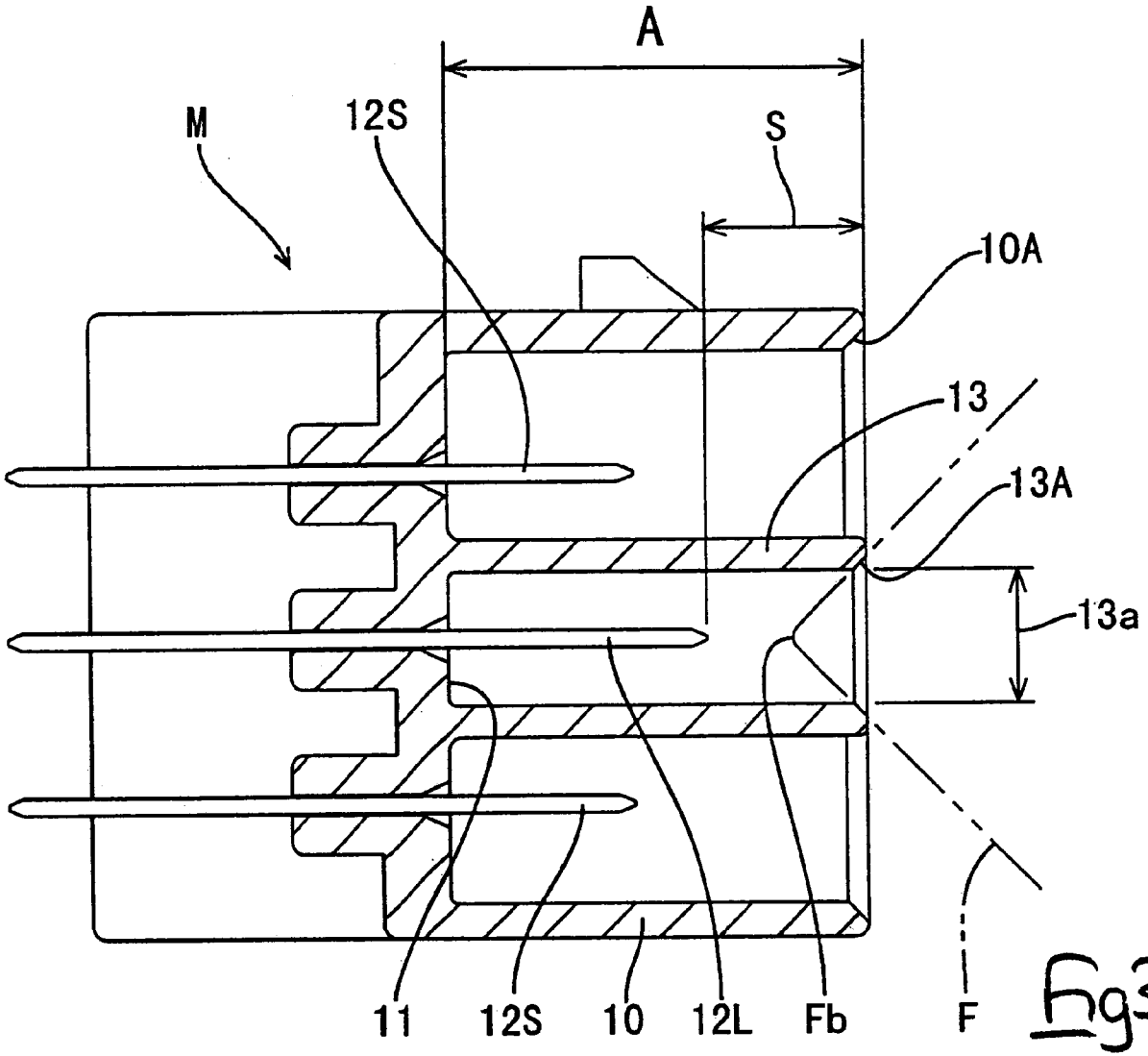
FIG. 3 is a cross-sectional view corresponding to FIG. 1.
Figure 4:
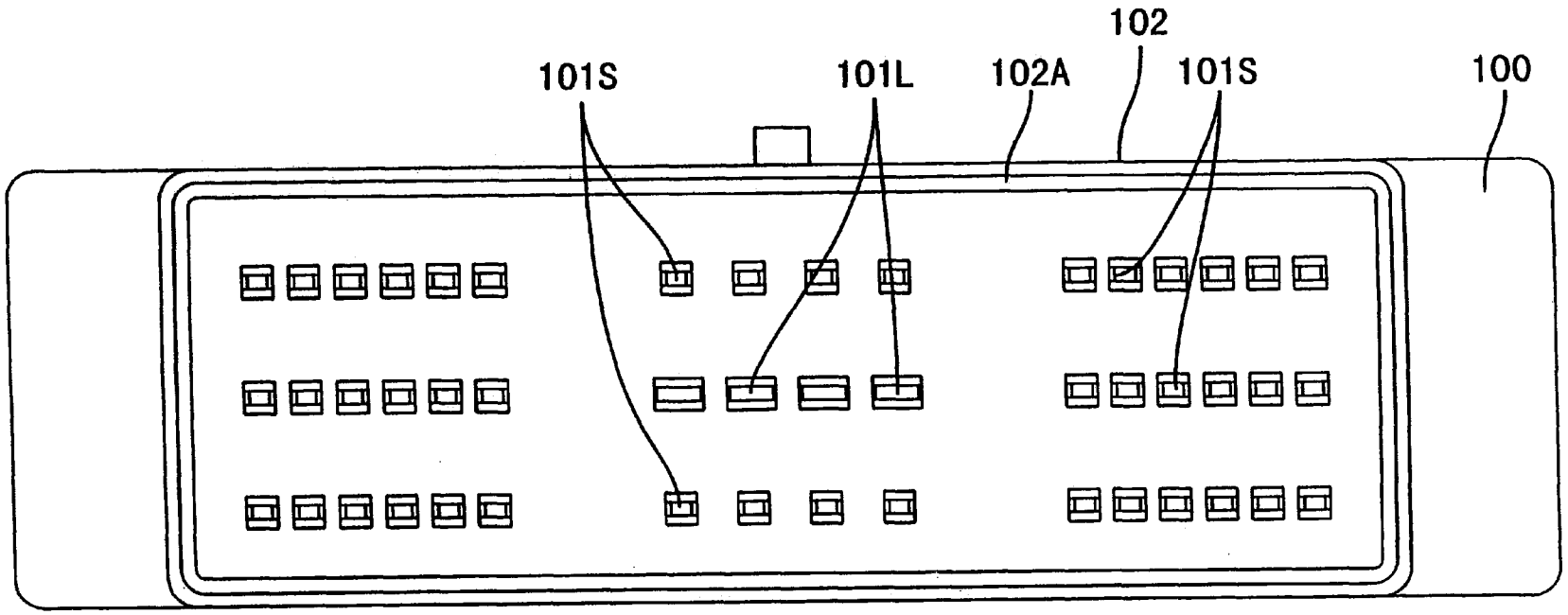
Fig 4 PRIOR ART
FIG. 4 is a front view of a prior art example.
Figure 5:
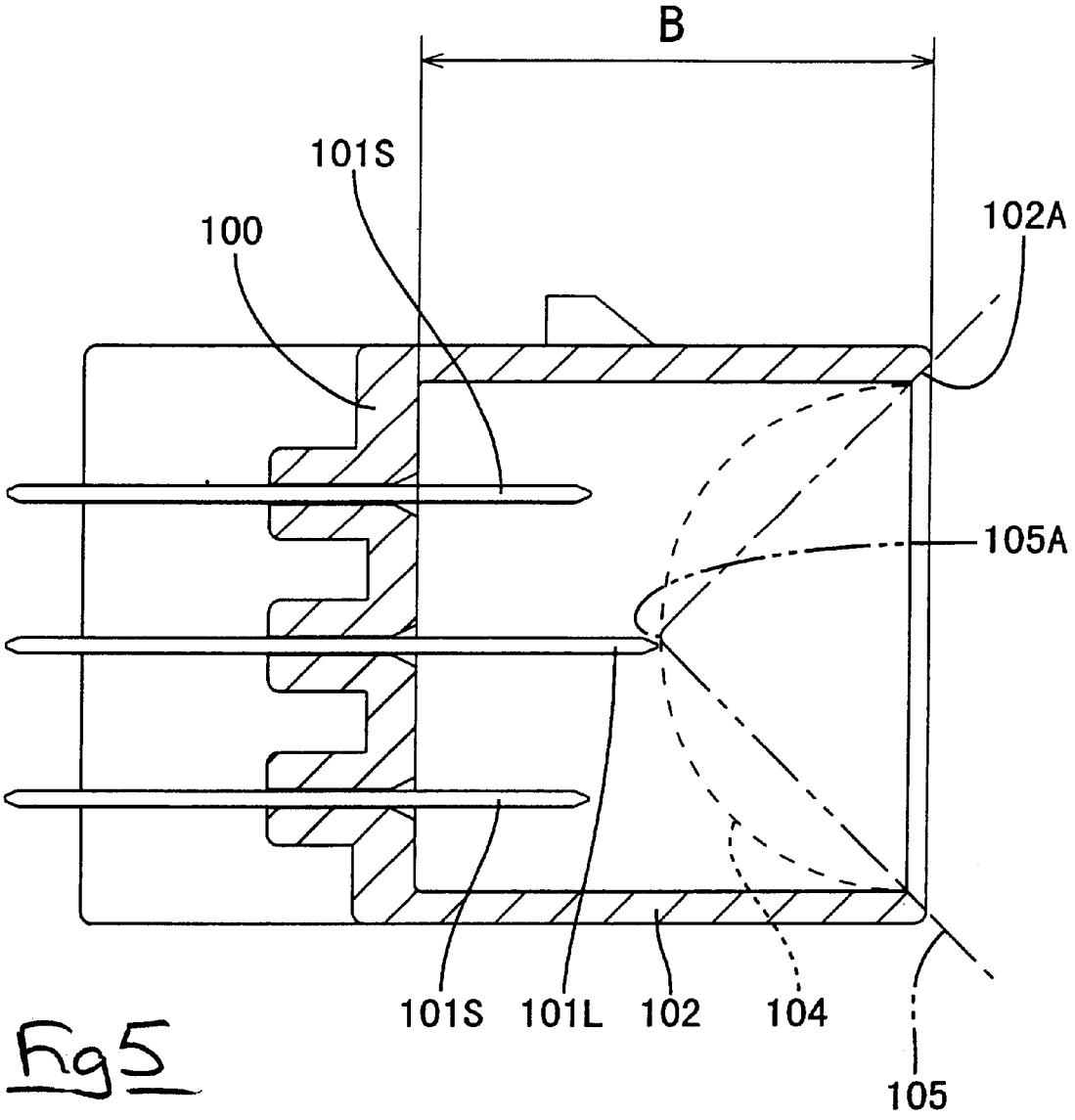
Fig5 PRIOR ART
FIG. 5 is a cross-sectional view of the prior art example.

As shown in FIG. 3, if the female connector F is inclined in both the up-down and left-right directions relative to the hood 10, it may seem that a corner Fb of the anterior end face of the female connector F will enter the cylindrical member 13. However, the up-down opening size 13*a* is the smaller of the opening sizes 13*a* and 13*b* of the cylindrical member 13. This opening size 13*a* is less than double the distance S (from the protruding end 13A of the cylindrical member 13 to the protruding ends of the long male terminal fittings 12L). Consequently, even if the corner Fb is inserted as deeply as possible into the cylindrical member 13 (see FIG. 3), this corner Fb will not reach the long male terminal fittings 12L. As a result, the corner Fb of the female connector F will not interfere with the long male terminal fittings 12L.

In the present embodiment, the corner Fb of the female connector F is prevented from interfering with the long male terminal fittings 12L by appropriately determining the length to which the cylindrical member 13 will protrude, taking into consideration the opening sizes 13*a* and 13*b* of the cylindrical member 13, and the distance S from the opening end of the cylindrical member 13 to the protruding ends of the long male terminal fittings 12L. That is, preventing interference between the female connector F and the long male terminal fittings 12 does not need to be taken into consideration in determining the protruding length of the hood 10. Consequently, the protruding length of the hood 10 can be shorter compared to a case where the cylindrical member 13 is not provided and the female connector F and the long male terminal fittings 12 are prevented from mutually interfering only by increasing the protruding length of the hood 10.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the cylindrical member entirely surrounds the long male terminal fittings. However, according to the present invention, the cylindrical member may equally well surround only a central portion of the long male terminal fittings that have been provided as a group. Additionally, the cylindrical member may surround all the long male terminal fittings and a portion of the short male terminal fittings that are adjacent thereto.

(2) In the embodiment described above, the connector is provided with only two types of male terminal fittings, long male terminal fittings and short male terminal fittings. However, the present invention is equally suitable for a connector provided with male terminal fittings of a length that is intermediate between these long male terminal fittings and short male terminal fittings.

(3) In the embodiment described above, the cylindrical member protrudes to the same position as the opening end of the hood. However, according to the present invention, the protruding end of the cylindrical member may be located inwards relative to the opening end of the hood (viewed from the fitting direction of the female connector).

Conversely, the protruding end of the cylindrical member may protrude further than the opening end of the hood.

What is claimed is:

1. An electrical connector having a body, long and short terminal fittings protruding from said body in a fitting direction, and a hood located on an exterior of said connector and surrounding said terminal fittings, the long terminal fittings being provided centrally in a group, and the short terminal fittings substantially surrounding the long terminal fittings, wherein a substantially tubular member, which is separate from said hood and surrounded by said hood, extends around and projects beyond at least some of said long terminal fittings, and at least one of the short terminal fittings is outside of the tubular member, said tubular member projecting in the same direction as said hood and defining a smaller opening than said hood, and being adapted to prevent contact between a mating connector and said long terminal fittings.

2. A connector according to claim 1 wherein said tubular member extends around all of said long terminal fittings.

3. A connector according to claim 1 wherein said tubular member encompasses only long terminal fittings.

4. A connector according to claim 1 wherein said hood and tubular member projects to the same extent.

5. A connector according to claim 1 wherein said tubular member has a continuous circumference.

6. A connector according to claim 5 wherein said tubular member extends around all of said long terminal fittings.

* * * * *

UNITED STATES PATENT AND TRADEMARK OFFICE

CERTIFICATE OF CORRECTION

PATENT NO. : 6,413,114 B2
DATED : July 2, 2002
INVENTOR(S) : Makoto Fukamachi

It is certified that error appears in the above-identified patent and that said Letters Patent is hereby corrected as shown below:

Title page,
Item [54], Title, please change the title from "CONNECTOR" to
-- CONNECTOR WITH LONG AND SHORT TERMINALS --.

Item [57], ABSTRACT,
Line 7, please change "Interferences" to -- Interference --.

Signed and Sealed this

Twenty-seventh Day of August, 2002

*Attest:*

*Attesting Officer*

JAMES E. ROGAN
*Director of the United States Patent and Trademark Office*